United States Patent [19]

Miyaki et al.

[11] Patent Number: 4,777,921

[45] Date of Patent: Oct. 18, 1988

[54] FUEL INJECTION SYSTEM

[75] Inventors: Masahiko Miyaki, Oobu; Takashi Iwanaga; Hideya Fujisawa, both of Kariya, all of Japan

[73] Assignee: Nippondenso Co., Ltd., Kariya, Japan

[21] Appl. No.: 44,859

[22] Filed: May 1, 1987

[30] Foreign Application Priority Data

May 2, 1986 [JP] Japan ..... 61-102743

[51] Int. Cl.[4] ..... F02M 39/00

[52] U.S. Cl. ..... 123/456; 123/506; 123/458; 123/494

[58] Field of Search ..... 123/456, 506, 500, 501, 123/494, 458

[56] References Cited

U.S. PATENT DOCUMENTS

| | | | |
|---|---|---|---|
| 4,404,846 | 9/1983 | Yamauchi | 123/494 |
| 4,545,352 | 10/1985 | Jourde et al. . | |
| 4,546,749 | 10/1985 | Ibashira | 123/494 |
| 4,566,417 | 1/1986 | Suzuki et al. . | |
| 4,583,510 | 4/1986 | Schechter | 123/506 |
| 4,586,656 | 5/1986 | Wich | 123/506 |
| 4,642,773 | 2/1987 | Miyaki | 123/501 |

FOREIGN PATENT DOCUMENTS

| | | | |
|---|---|---|---|
| 2165895 | 4/1986 | United Kingdom | 123/506 |

*Primary Examiner*—Carl Stuart Miller

*Attorney, Agent, or Firm*—Cushman, Darby & Cushman

[57] ABSTRACT

A fuel injection system for a diesel engine has fuel pump driven by the engine for producing highly pressurized fuel, a common rail for storing the pressurized fuel therein and injection nozzles for injecting the pressurized fuel stored in the common rail into the engine. The injection nozzles are electrically controlled in accordance with engine operating conditions (N, α) by the use of injection control solenoid valves provided between the injection nozzles and the common rail. The fuel pump is electrically controlled in accordance with the engine operating conditions by the use of a spill control solenoid valve which spills the pressurized fuel to a low pressure fuel channel so that loss of engine torque required by the pump is reduced.

14 Claims, 6 Drawing Sheets

FUEL INJECTION SYSTEM

BACKGROUND OF THE INVENTION

The present invention relates to high-pressure fuel injection system for use in a diesel engine or the like.

In recent years, a high pressure common-rail high-pressure fuel injection system for diesel engines has been proposed as disclosed in Japanese Patent Laid-Open No. 165858/1984 (U.S. Pat. No. 4,545,352 to Jourde et al).

The most important technical functions for the above-described high-pressure common-rail fuel injection system is to create, maintain, and control a fuel pressure corresponding to an injection pressure inside the common rail. However, a pump incorporated in the system for producing high pressure fuel is driven by the engine and unable to reduce loss of torque of the engine. Further, the pump could not be made compact. For these reasons, no practical system has been made available on the market.

SUMMARY OF THE INVENTION

It is a primary object of the present invention to provide an improved high-pressure common-rail fuel injection system which is compact, economical to fabricate, capable of operating with small torque loss by the use of a variable delivery pump as a high-pressure pump.

It is a secondary object of the invention to control the delivery stroke of a variable delivery pump by an electronically-controlled spill solenoid valve mechanism.

DETAILED DESCRIPTION OF THE PREFERRED EMBODIMENT

Figure 1:
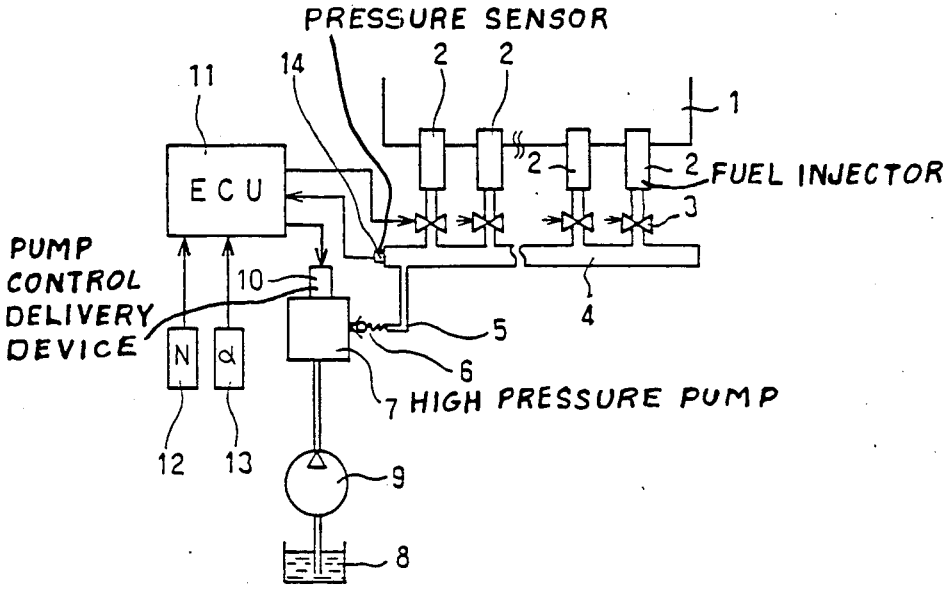
FIG. 1 is a schematic diagram of the high-pressure common-rail fuel injection system according to the present invention.
Figure 2A:
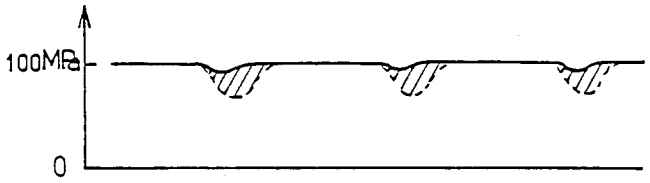
FIGS. 2A–2D are time charts for illustrating the operation of the system shown in FIG. 1.
Figure 2B:
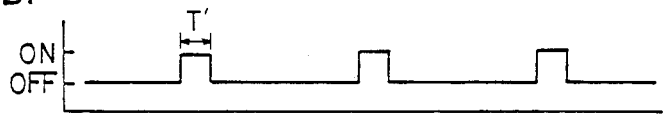
Figure 2C:
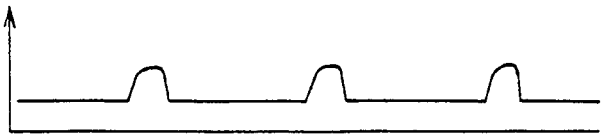
Figure 2D:
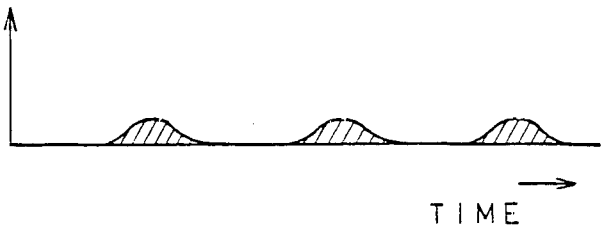

Reference is made first to FIG. 1 in which a high-pressure common-rail fuel injection system is shown schematically. A diesel engine 1 is provided with injection nozzles or injectors 2 for each cylinders thereof. Supply of fuel from the injectors 2 into the engine 1 is controlled electrically by energizing and deenergizing fuel injection control solenoid valves 3. The injectors 2 and solenoid valves 3 are all connected to a common rail 4 which stores high pressure fuel therein. When the injection control solenoid valves 3 are open, the fuel inside the rail 4 is injected into the engine 1 by means of the injectors 2. Therefore, it is necessary that the pressure inside the rail 4 be maintained at a certain high pressure corresponding to fuel injection pressure and have a sufficient volume for storing fuel. For this purpose, a high-pressure supply pump 7 driven by the engine 1 is connected to the rail 4 via a supply pipe 5 and a check valve 6. The high-pressure supply pump 7, which will be described in detail with reference to FIG. 3, raises the pressure of fuel sucked from a fuel tank 8 via a known low-pressure supply pump 9 to a much higher pressure needed for the system. To reduce the loss of engine torque used for the pump 7, the pump 7 is equipped with a pump delivery control device 10 having an electrically-controlled solenoid valve. The control device 10 will be described later with reference to FIG. 6.

This system is controlled by an electronic control unit (ECU) 11 to which an engine speed sensor 12 and a load sensor 13 supply data regarding the rotational speed N and the load (accelerator position $\alpha$), respectively. The control unit 11 produces a control signal to the fuel injection control solenoid valves 3, in order that the fuel injection timing and the amount of injection, or fuel injection period, be optimized according to the engine conditions which are determined from the input signals. Also, the unit 11 delivers a control signal to the pump delivery control device 10 to optimize the injection pressure according to the load and the engine speed. Preferably, a pressure sensor 14 for detecting an actual fuel pressure is disposed in the rail 4. The amount of delivery from the pump 7 is feedback-controlled in such a way that the actual fuel pressure detected by sensor 14 is controlled to an optimum value predetermined according to the load and the engine speed.

The aforementioned concept of the control over the pressure inside the common rail 4 is illustrated in the time chart of FIG. 2. It is assumed that the pressure inside the common rail 4 is raised to 100 MPa as shown in FIG. 2A. Whenever a control pulse T' shown in FIG. 2B is produced from ECU 11 to the solenoid valve 3, a certain amount of fuel indicated in FIG. 2A by the hatched lines is consumed because of the fuel injection shown in FIG. 2C. This amount corresponds to the amount of fuel injection plus the amount of fuel consumed by hydraulic servo control over the nozzles. In order to replenish this fuel and to retain the fuel pressure inside the rail 4 at 100 MPa (about 1000 kg/cm$^2$), the high-pressure pump 7 supplies the same amount of fuel as the consumed amount of fuel indicated by the hatched lines in FIG. 2D into the rail 4. Of course, this amount varies according to the amount of injection and the engine speed. Therefore, the delivery control device 10 functions effectively under all different conditions. For example, when the amount of fuel injection is very small, the fuel delivery from the pump 7 is small. Inversely when the amount of fuel injection is maximum, a corresponding large amount of fuel delivery from the pump 7 is needed. As described previously, the fuel pressure inside the rail 4 is always monitored by the pressure sensor 14. The amount of injection is controlled every time so that the level of this fuel pressure may be equal to a certain value that has been previously determined according to the engine load and the speed. Thus, the pressure can be controlled more accurately.

In order to supply, maintain, and control the high fuel pressure in the rail 4, it is advantageous to replenish fuel in synchronism with the cycle of the operation of the fuel injection system. Therefore, it is preferred to use an intermittently reciprocating jerk pump shown in FIG. 3 for delivering fuel as many times as the number of combustions or injections in the engine 1.

Figure 3:
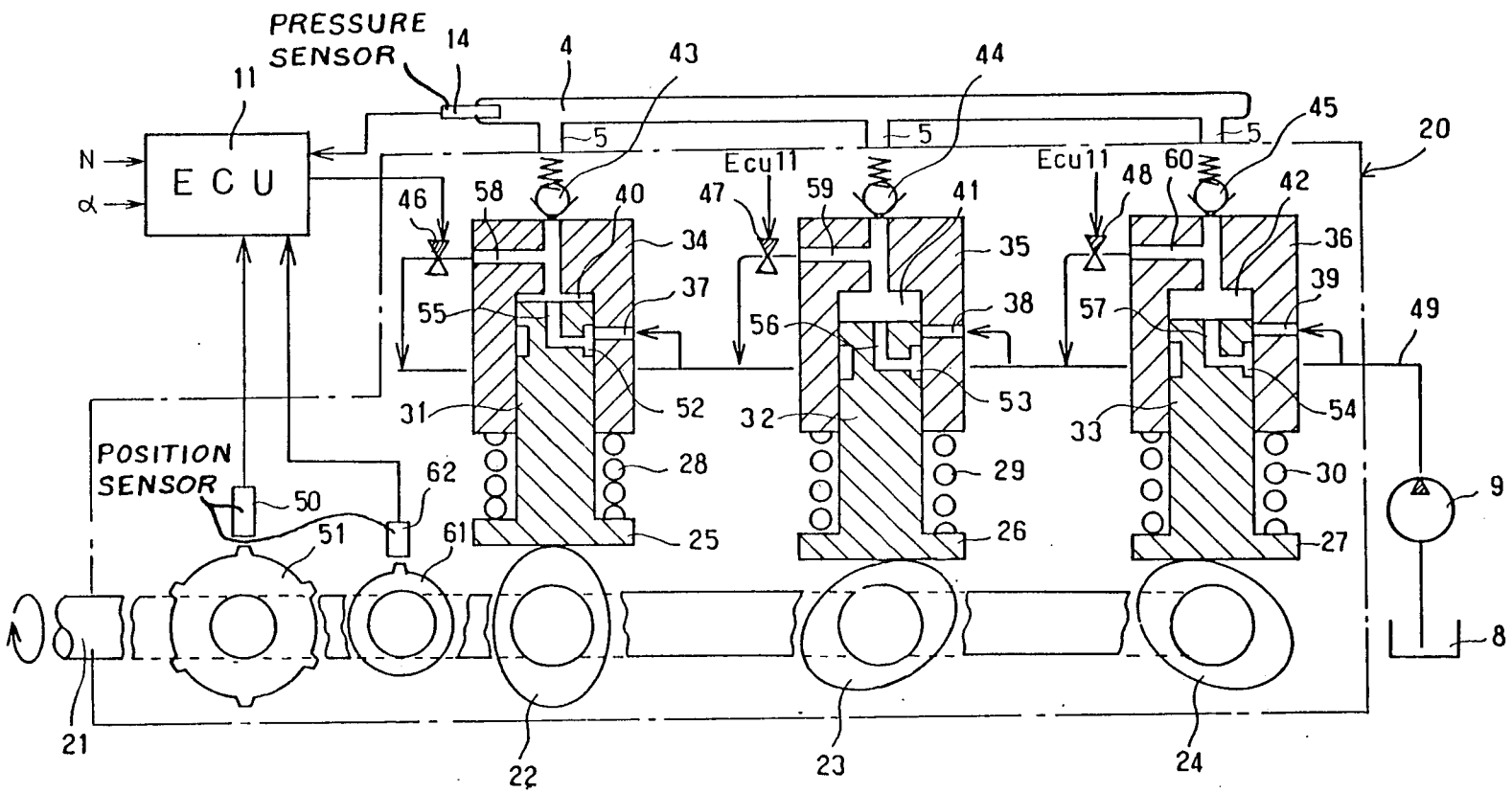
FIG. 3 is a detailed diagram illustrating detailed structure of a high-pressure pump of the fuel injection system shown in FIG. 1.

Referring to FIG. 3, a control pump 20 indicated by the dot-and-dash line includes the high-pressure pump 7 and the pump delivery control device 10 shown in FIG. 1. This control pump 20 is essentially identical in structure with a conventional in-line pump. The pump 20 has a camshaft 21 which is rotated by the engine and rotates at a speed half of the engine speed and acts as the driving shaft of the pump. The camshaft 21 is provided with three cams 22, 23 and 24 which make two upward movements per rotation of the camshaft 21, i.e., each cam has two crests. The angles that these three cams 22, 23 and 24 make to the camshaft are 120° out of phase with each other.

Pumping plungers 31,32 and 33 are pressed downwardly as viewed in the Figure against the cams 22, 23 and 24 by plunger springs 28,29 30 via cam followers 25,26 and 27, respectively. The plungers 31, 32 and 33 fit in plunger barrels 34, 35 and 36, respectively, in and oiltight manner. Pump chambers 40, 41 and 42 are formed between the top portions of the plungers and the barrels, and are connected with the common rail 4 via check valves 43, 44 and 45, respectively. The barrels 34, 35 and 36 are provided with feed holes 37, 38 and 39, respectively, in the same manner as the conventional in-line pump. A low-pressure fuel channel 49 that is filled with fuel is in communication with the holes 37, 38 and 39. The low-pressure supply pump 9 supplies fuel into the channel 49 at a constant low pressure from the tank 8.

The pump chambers 40, 41 and 42 are communicated with spill passages 58, 59 and 60, respectively. Spell control solenoid valves 46, 47 and 48 which are normally-open type are mounted in return passageways extending from the passages 58, 59 and 60 to the channel 49. These return passageways are closed only when the valves 46, 47 and 48 are energized.

Figure 4:
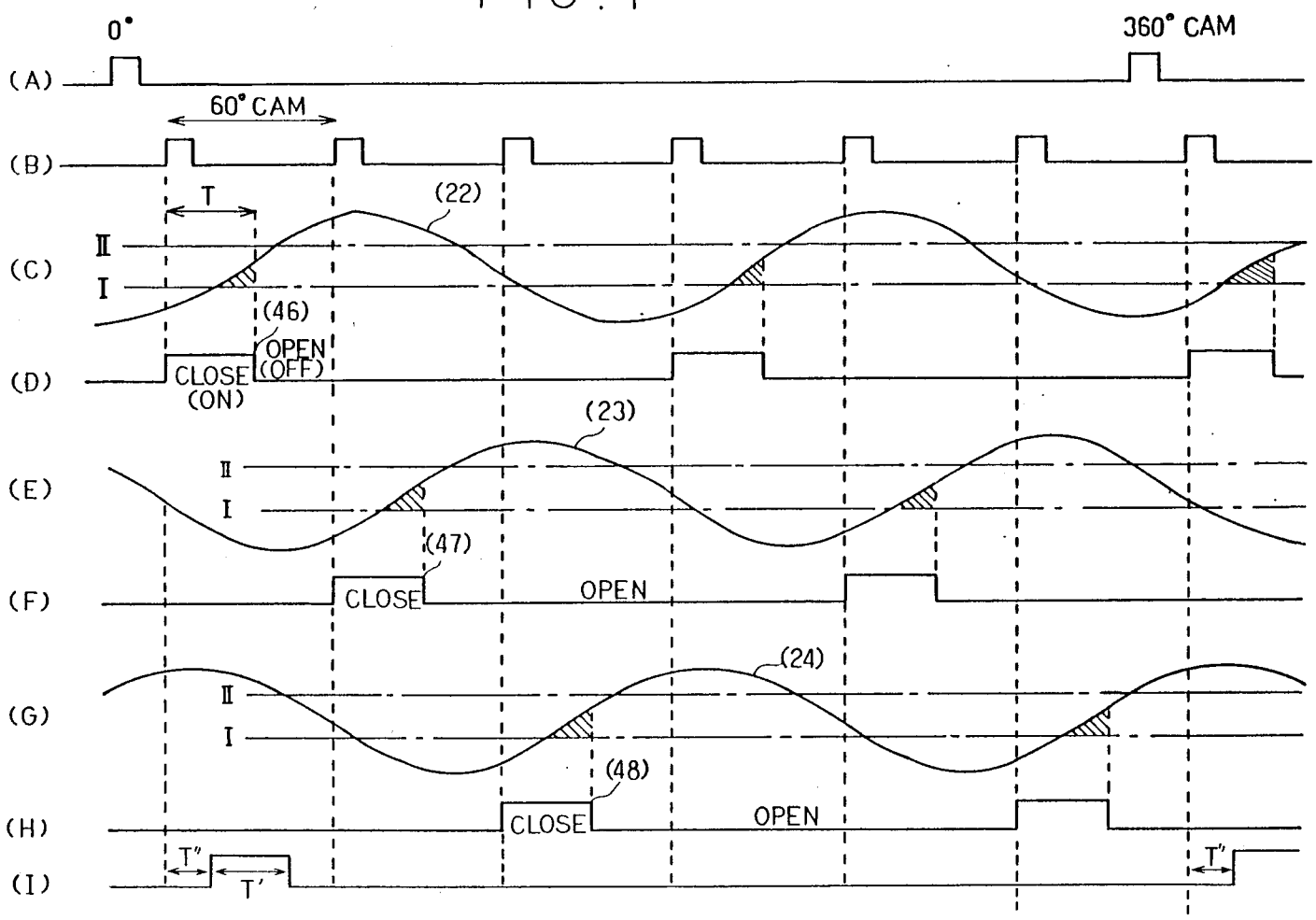
FIG. 4 is a time chart for illustrating one operational mode of the system shown in FIG. 3.

The operation of the structure described above is now described in detail by referring to FIGS. 3 and 4. FIG. 4 is a time chart for illustrating the operation of the present high-pressure 20 during about one revolution of the pump, i.e., over 360° of the angular interval cylinder sensor 62 shown in FIG. 3. (A) of FIG. 4 shows the output signal from the cylinder sensor 62 and (B) of FIG. 4 shows the output signal from the cam angular position sensor 50.

A rotary disk 51 having protrusions corresponding to the number of the engine cylinders are mounted coaxially with the camshaft 21 to control the solenoid valves 46, 47 and 48. In this example, the number of the protrusions is six. A cam angular position sensor 50 that is a known electromagnetic pickup is disposed opposite to the protrusions. Whenever any one of the protrusions passes by the sensor 50, the sensor feeds a signal to the control unit 11 so that angular position of the shaft 21 and the rotational speed are detected. The disk 51 is so mounted that each of the cams 22, 23 and 24 comes closest to the sensor 50 when it is located near its lower dead point. Also, a disk 61 and a cylinder sensor 62 for discriminating between the cylinders are mounted coaxially with the camshaft 21. The disk 61 is provided with only one protrusion. Accordingly, the control unit 11 receives one signal from the sensor 62 per revolution of the camshaft 21. The control unit 11 can correctly know from which of the cylinders does the signal indicating the lower dead point is produced, from the output signals from the sensors 62 and 50. The plungers 31, 32 and 33 are provided with spill grooves 52, 53 and 54, respectively, which register with the feed holes 37, 38 and 39, respectively, at the end of the delivery stroke of each plunger. The grooves 52, 53 and 54 are invariably in communication with the pump chambers 40, 41 and 42, respectively, via communication holes 55, 56 and 57, respectively.

(C), (E) and (G) of FIG. 4 show the movement of the cams 22, 23 and 24, respectively. Since the structure shown has three cylinders and each cam has two crests, as the camshaft 21 rotates once, fuel is delivered six times, corresponding to the number of the cylinders. The dot-and-dash line I indicates the instant at which delivery of fuel is started, i.e., the feed hole 37 is fully covered by the side wall of the plunger 31. The dot-and-dash line II indicates the instant at which the spill groove 52 comes into registry with the feed hole 37 to stop further pressurization of fuel.

The pump 20 shown in FIG. 3 pressurizes fuel high and delivers pressurized fuel into the common rail 4 during the interval between the instants I and II corresponding to the delivery stroke under the condition that valves 46, 47 and 48 are kept closed. However, the amount of delivery is controlled by the spill solenoid valve 46 mounted separately so as to shorten the delivery stroke in effect. Of course, the instant II at which fuel spills through spill grooves 52, 53 and 54 must be so determined that the maximum delivery amount required by the system can be sufficiently treated.

(D), (F) and (H) of FIG. 4 show control signals supplied to the solenoid valves 46, 47 and 48, respectively, shown in FIG. 3. In the present example, the control unit 11 energizes the solenoid valve 46, 47 and 48 for the cylinder which next enters into delivery stroke, to close the spill passages 58, 59 and 60 in synchronism with the corresponding signal indicating the angular position of the cam. After a time T corresponding to the amount of delivery required by the system elapses, the valve is deenergized to open it. Therefore, the effective delivery stroke of the pump 20 starts at the instant I and ends at an instant at which fuel spills from the spill passage through the spill solenoid valve prior to the instant II. Thus, fuel indicated by the hatched lines in FIG. 4 is delivered into the common rail 4. The time T can be increased or decreased according to the detected load, engine speed, and actual fuel pressure. Hence, the amount of fuel delivery of the pump 20 supplied into the common rail 4 can be controlled. A control signal to the injection valve 2 for the first cylinder is shown in (I) of FIG. 4.

As can be understood from the description made thus far, in practice, fuel spills always through the spill control solenoid valves 46, 47 and 48. The instant II at which spill occur through spill grooves 52, 53 and 54 does not affect control over the system. It is to be noted here that, since the fuel in the chamber 40 is spilled to the low pressure channel 49 through the spill valves 46, 47 and 48 at the end of the time T in the fuel delivery stroke of the pump 20, loss of torque of the engine is reduced after the time T even in the fuel delivery stroke of the pump 20. The spill grooves 52, 53 and 54 and the communication holes 55, 56 and 57 are formed to prevent the amount of delivery from increasing excessively when the valves 46, 47 and 48 malfunction, and also to help the pump chambers 40, 41 and 42 suck fuel when the crests of the cams 22, 23 and 24 are moving downward. Since the spill grooves 52, 53 and 54 and the holes 55, 56 and 57 are not essential to the invention, they may be omitted, in which case each of the plungers 31, 32 and 33 can be shaped into a simple cylinder. This simplifies the machining operation and reduces the cost.

Figure 5:
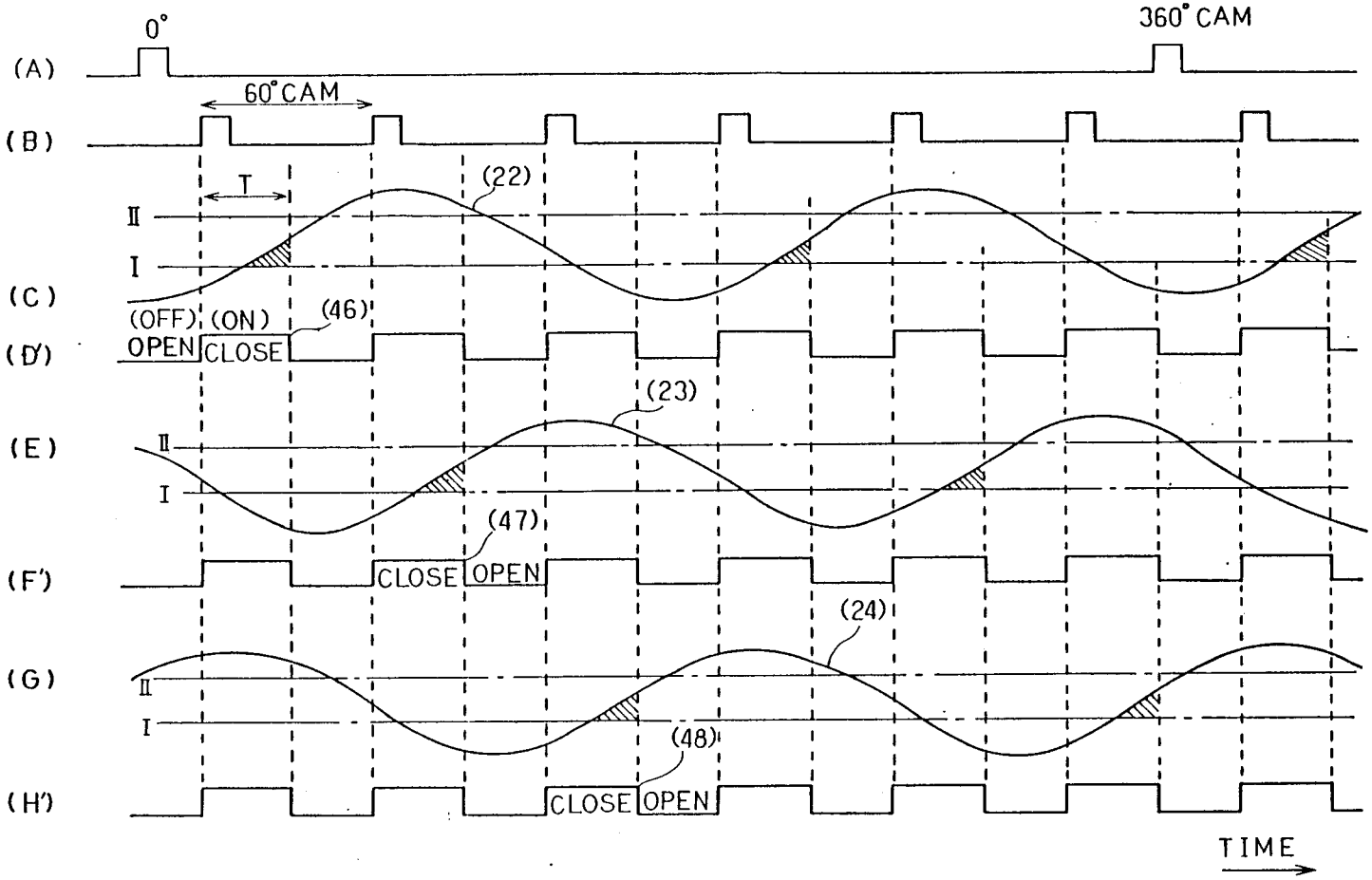
FIG. 5 is a time chart for illustrating another operational mode of the system.

The time chart of FIG. 5 illustrates another operational mode of the system. The difference of this mode from the mode shown in FIG. 4 resides in the operation of the solenoid valves 46, 47 and 48 shown in (D'), (F') and (H') in FIG. 5. More specifically, one cylinder is actually in delivery stroke, and the other two cylinders are turned on and off in synchronism with the turning on and off of the former cylinder. As can be understood from this Figure, for the two cylinders which are not in delivery stroke, when the spill control valves are closed, e.g., when plunger 31 is in delivery stroke, (E) is in suction stroke in which the feed holes have been already opened, and plunger 33 is in spilling stroke during which the spill groove 54 is open. Consequently, the control over the system is not adversely affected at all in spite of the simultaneous control. In the example shown in FIG. 5, all the spell solenoid valves 46, 47 and 48 are controlled in common at the same time and electronic control by the ECU 11 is simplified. Therefore, it is not necessary to discriminate between the cylinders. Further, only one common driver circuit in the ECU 11 is needed to actuate the solenoid valves 46, 47 and 48.

Figure 6:
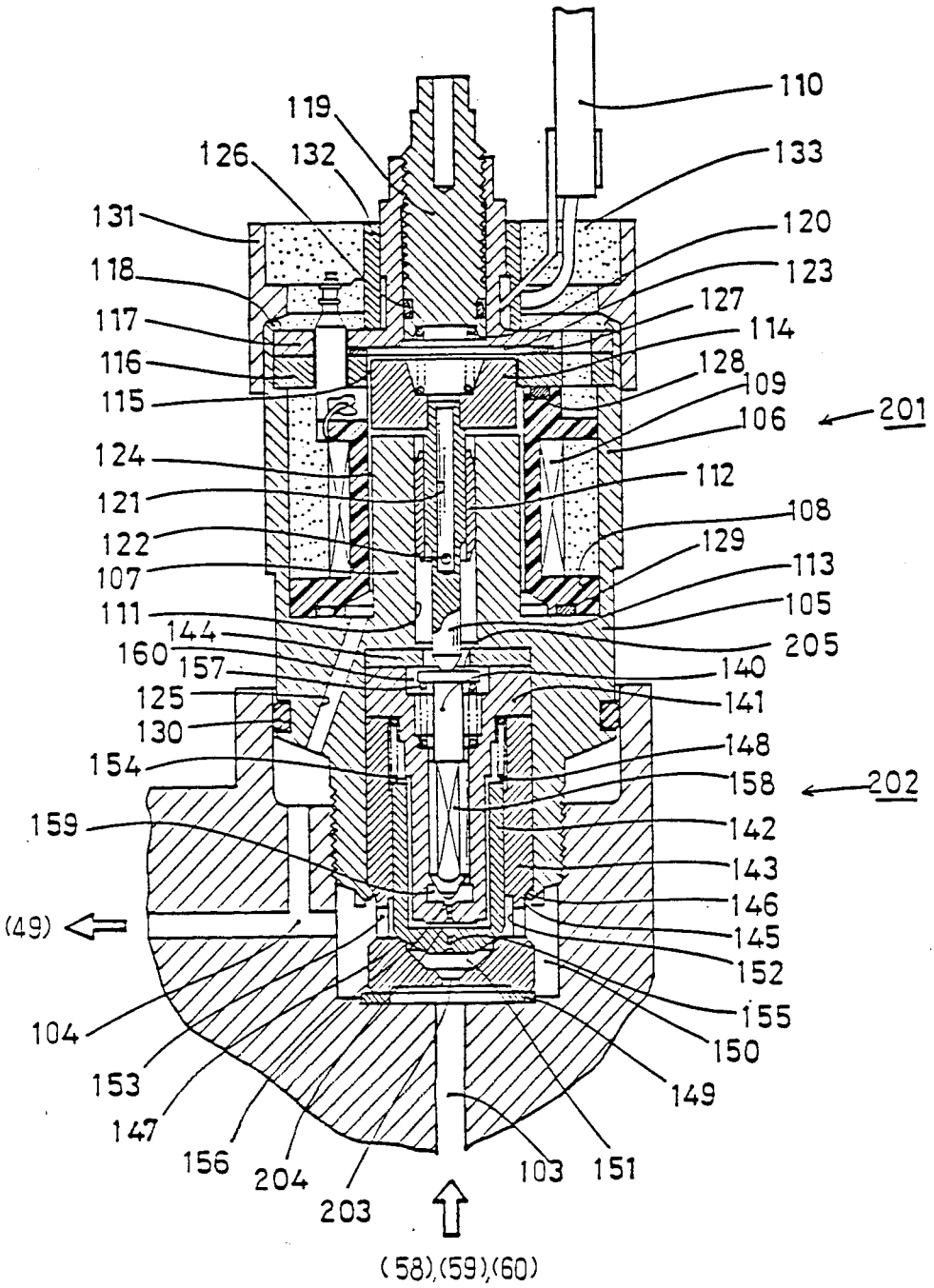
FIG. 6 is a cross-sectional view of a spill control solenoid valve shown in FIG. 3.

FIG. 6 is a cross-sectional view showing particularly one representative structure of the spill control solenoid valves 46, 47 and 48 shown in FIG. 3. The spill solenoid valves 46, 47 and 48 used in this fuel injection system must withstand pressures higher than the fuel pressure inside the common rail 4 which reaches as high as 100 MPa. In addition, they are required to operate with quick response. Preferably, when they are not energized, they open to permit the fuel to escape in case of emergency, such as breaking of electrical wire or disconnection of an electrical connector.

The structure of the solenoid valve 46, 47 and 48 shown in FIG. 6 is now described in detail. This valve is disposed in the passageway which connects the spill passages 58, 59 and 60 to the low-pressure fuel channel 49, the passages 58, 59 and 60 of the high-pressure supply pump 20 shown in FIG. 3. A high-pressure passage 103 is in communication with the spill passages 58, 59 and 60 extending from the pump chambers in high-pressure supply pump (not shown). A spill passage 104 is in communication with the low-pressure fuel channel 49 (not shown in this figure). This solenoid valve is roughly cylindrical in shape and symmetrical with respect to its central axis. The valve has a housing 105 also forms a member of a magnetic circuit for a solenoid. A solenoid actuator portion 201 which acts as a solenoid is mounted in an upper portion of the housing 105. A valve portion 202 for permitting and stopping the the flow of a high-pressure fluid is mounted in a lower portion of the housing 105.

The structure of the solenoid actuator portion 201 is now described. The housing 105 has an upper outer cylinder which is symmetrical with respect to its central axis. This outer cylinder constitutes a yoke 106 for the solenoid. The housing also has an upper inner cylinder that constitutes a stator 107 for the solenoid consisting of a bobbin 108 and a coil 109. The bobbin 108 is molded out of resin. The solenoid is fitted between the yoke 106 and the stator 107. The coil 109 is connected with the electronic control unit 11 (not shown) by a lead wire 110. A guide hole 111 is formed along the axis of the stator 107. A bush member 112 made of a hard material is mounted in the hole 111 with a press fit and fixed there. A rod-like member 113 shaped like a shaft is supported by the bush member 112 so as to be slidable axially. The rod-like member 113 is made of a nonmagnetic material, and its sliding surface and the lower end which bears on a valve member are hardened. An annular core 114 is rigidly fixed to the upper end of the rod-like member 113, and is disposed opposite to the upper end surface of the stator 107. An annular stator plate 116 is mounted around the core 114 such that a circumferential gap 115 of a given width is left between them. The yoke 106 has a flange 118 at its upper end. The stator plate 116 and a top plate 117 are gripped by the flange 118 and firmly joined to the housing 105. The plate 116 and the yoke 106 are maintained in magnetic conduction. The magnetic circuit starts from the coil 109, passes through the stator 107 over which the bobbin 108 is fitted, the core 114 via the space, the stator plate 116 via the circumferential gap 115, the yoke 106, and returns to the stator 107. When the coil 109 is energized, the core 114 is attracted downwardly to the stator 107.

The top plate 117 has a screwed portion at its center, and an adjusting screw 119 engages with this screwed portion. A compressed spring 120 is mounted between the screw 119 and the core 114 to bias the core 114 and the rod-like member 113 downward as viewed in the Figure. This spring 120 urges a pilot valve (described later) to open.

The rod-like member 113 has an axially extending slot 121 that extends to the upper end of the member. The rod-like member 113 is also provided with a small lateral hole 122 that intersects with the slot 121 near the lower end of the slot 121. A space 123 located above the core 114 and a space formed by the guide hole 111 are placed in communication with each other through the slot 121 and the hole 122, the latter space being located under the bush member 112. A multiplicity of axially extending grooves 124 are formed in the inner wall of the bobbin 108. The upper and lower flange surfaces of the bobbin 108 are interconnected by the passages formed by the grooves 124. The housing 105 is further formed with an inclined hole 125 to connect the grooves 124 with the spill passage 104. Therefore, the guide hole 111 located under the bush member 112 is in communication with the spill passage 104 by way of the small hole 122, the slot 121, the space 123 located over the core, the circumferential gap 115, the grooves 124, and the inclined hole 135. To make this communication passage oiltight, and O-ring 126 is mounted between the top plate 117 and the adjusting screw 119. Another O-ring 127 is mounted between the top plate 117 and the stator plate 116. A further O-ring 128 is mounted between the stator plate 116 and the upper flange of the bobbin 108. A still other O-ring 129 is mounted between the lower flange of the bobbin 108 and the housing 105. These O-rings 126 through 129 are disposed coaxially with the rod-like member 113. A yet further O-ring 130 is mounted between plunger barrel of the pump body and the housing 105, and these are assembled in an oiltight manner.

A cover ring 131 is fitted over the upper end portion of the housing 105. The space inside the housing 105 which is located outside of the O-rings 126 through 129, including the space between the cover ring 131 and a ring 132 and the space between the coil 109 and the housing 105, is filled with epoxy resin 133 to enhance the mechanical rigidity and heat dissipation from the coil 109.

The structure of the valve portion 202 is now described. The valve portion 202, consists of of a first pilot valve of a small capacity and a second main valve of a large capacity. The first valve consists mainly of a pilot valve needle 140 and a pilot valve body 141. The second valve consists primarily of a main valve spool 142 and a main valve body 143.

The housing 105 is provided with a cylinderical recess at the bottom. A spacer 144 for adjusting the axial dimension of the assembly, a cylindrical pilot valve body 141, and a cylindrical main valve body 143 are rigidly fitted in the recess. The outer surface of the main valve body 143 is provided with a groove 145 in which a flange 146 mounted at the lower end of the housing 105 is fitted, so that the valve body 143 is coupled to the housing 105. The cylindrical main valve spool 142 is accurately and fitly mounted in the recess in the valve body 143 so as to be axially slidable in an oiltight manner. The fringe of the lower end of the spool 142 bears on the bottom of the recess inside the valve body 143 to form a seat 147 for the main valve. The valve spool 142 is biased downward as viewed in the Figure by a compression spring 148 to close the seat 147. When this solenoid valve is mounted on the plunger barrel of the high pressure pump shown in FIG. 3, the lower end of the valve body 143 is pressed against an annular seat plate 149 that is firmly fixed to the plunger barrel. Thus, the space 150 formed around the main body 143 and communicating with the spell passage 104 is isolated from the high-pressure passage 103. The valve body 143 is provided with an axial hole 203 at its bottom to place the high-pressure passage 103 into communication with a high-pressure chamber 151 surrounded by the valve body 143 and the valve spool 142. An annular groove 152 which surrounds the seat 147 is formed in the recess inside the main valve body 143 to form a small oil chamber. The annular groove 152 is in communication with the surrounding space 150 through a plurality of horizontal holes 153.

The pilot valve body 141 has a cylindrical lower portion that is received in the cylindrical recess inside the main valve spool 142. An oil chamber 154 is defined by the inner wall of the valve spool 142, the outer wall of the pilot valve body 141, and the main valve body 143. The oil chamber 154 also acts as a spool chamber in which the valve spool 142 slides axially. The compression spring 148 is mounted in this oil chamber 154, which is in communication with the high-pressure chamber 151 via an orifice 155 of a small diameter. The orifice 155 is formed at the bottom of the main valve spool 142. The high-pressure chamber 151 is located upstream the seat 147. The pilot valve has a seat 156 being mounted at the bottom of the pilot valve body 141.

A pilot valve needle 140 is accurately mounted in the pilot valve body 141 so as to be axially slidable. The lower end of the needle 140 is engaged in an opening 204 formed at the bottom of the valve body 141. In this way, the seat 156 of the pilot valve is constituted. The needle 140 is biased upward as viewed in the Figure by a compression spring 157 to open the seat 156. The valve needle 140 has a flange 205 at its upper end. This flange 205 is pressed against the lower end of the rod-like member 113. As described above, the rod-like member 113 is biased downward by the spring 120. The resultant forces produced by the first spring 157 and the spring 120 are identical in specifications, including spring constant, free length, diameter of wire, and number of turns. The adjusting screw 119 is adjusted to vary the length of the spring 120 so that the lengths of the two springs may differ. Thus, the forces produced by them differ. As a result, a force directed upward is produced.

A notch 158 is formed on the side surface of the pilot valve needle 140 to place a valve chamber 159 into communication with a spring chamber 160 in which the spring 157 is disposed. The valve chamber 159 is located downstream the pilot valve seat 156. The spring chamber 160 is in communication with the guide hole 111 formed in the solenoid actuator 201. Therefore, the fuel passing through the pilot valve seat 156 then flows through the valve chamber 159, the notch 158, the spring chamber 160, the guide hole 111, the small hole 122 and the slot 121 in the rod-like member 113, the space 123 located above the core 114, the circumferential gap 115 between the core 114 and the stator plate 116, the large number of grooves 124 in the inner wall of the bobbin 108, and the inclined hole 125. Thereafter, the fuel flows into the spell passage 104.

It is necessary that when the pilot valve is open, the flow of fuel passing through the seat 156 be larger than the flow of fuel passing through the orifice 155 in the main valve spool 142. Also, it is desired that the former flow be less than 1.5 times the latter flow. It has been accertained experimentally that when the pilot valve needle 140 is open away from the seat 156, an upward shift of about 0.1 mm and setting the diameter of the orifice 155 within the range from 0.4 mm to 0.6 mm produce desirable results. Also, when the main valve spool 142 is open away from the seat 147, the upward shift is preferably in the range from 0.1 mm to 0.5 mm. When the pilot valve is closed, i.e., when the coil 109 is energized to attract the coil 114 to the stator 107, the valve needle 140 is depressed within an appropriate force. Therefore, it is desired that a slight gap is left between the core 114 and the stator 107. Preferably, the thickness of the spacer 144 is determined such that the width of the gap is about 0.1 mm.

The operation of the spill solenoid valve constructed as described above is now described. Under the free condition, i.e., when the coil 109 is not energized and no hydraulic pressure exists in the high-pressure passage 103, the resultant forces produced by the spring 157 and the spring 120 raised the pilot valve needle 140, opening the seat 156 of the pilot valve. The main valve spool 142 is urged downward by the action of the compression spring 148. Thus, the seat 147 of the main valve is closed. This condition is shown in FIG. 6.

When the coil 109 is energized as shown in (D), (F) and (H) in FIG. 4 for instance, the core 114 is attracted to the stator 107. The rod-like member 113 pushes down the valve needle 140, closing the seat 156 of the pilot valve. A pump (not shown) forces fuel into the high-pressure passage 103 at a high pressure. The fuel then enters the high-pressure chamber 151 within the solenoid valve, passes through the orifice 155 in the main valve spool 142, and fills the inside of the oil chamber 154. Since the seat 156 of the pilot valve is closed, the hydraulic pressure inside the high-pressure chamber 151 is equal to the hydraulic pressure inside the oil chamber 154. The hydraulic forces applied to the main valve spool 142 from above and from below, respectively, are now discussed. The downwardly directed force for closing the valve acts on a circle of a diameter equal to the outside diameter of the valve spool 142. The upwardly directed force for opening the valve acts on a circle of a diameter equal to the diameter of the seat 147. Since the outside diameter of the valve spool 142 is larger than the diameter of the seat 147, of course, the resultant hydraulic force acting on the valve spool 142 is directed downward to close the valve. Therefore, as the hydraulic pressure inside the hydraulic chamber 151 increases, the valve spool 142 is pressed against the seat 147 with higher pressure. However high the pressure inside the high-pressure passage 103 is, the seat 147 is closed with higher certainty. Hence, it is unlikely that the high pressure of fuel leaks away. As mentioned above, the seat 156 of the pilot valve is so designed that the flow of fuel passing through the seat 156 is larger than the flow of fuel passing through the orifice 155 and that the former flow is less than 1.5 times the latter. Since the diameter of the seat 156 is sufficiently small, the hydraulic force which raises the pilot valve needle 140 is relatively small. Consequently, a small force is needed to attract the core 114 to close the seat 156 with certainty. This permits a solenoid actuator 201 including the coil 109 to be fabricated in small size.

When the coil 109 is deenergized as shown in (D), (F) and (H) in FIG. 4 for instance, the force attracting the core 114 disappears. Then, the valve needle 140 pushed by the rod-like member 113 is rapidly moved upward by the upwardly directed resultant forces produced by the spring 157 and the spring 120, and also by the hydraulic force applied to the seat 156. This opens the seat 156. Then, the high pressure of fuel in the oil chamber 154 flows from the seat 156 into the spill passage 104 through the valve chamber 159, the notch 158, the spring chamber 160, the guide hole 111, the small hole 122, the slot 121, the space 123 located above the core 114, the circumferential gap 115, the multiplicity of grooves 124 formed in the inner wall of the bobbin 8, and the inclined hole 125. The heat produced by the bobbin 108 is removed by the fuel passing through the many grooves in the inner wall of the bobbin 108. This helps dissipating the heat from the coil 109. Since the flow of fuel passing through the valve seat 156 is larger than the flow of fuel passing through the orifice 155, the flow of fuel lost from the seat 156 cannot be compensated by the fuel supplied through the orifice 155. Accordingly, the pressure inside the oil chamber 154 decreases rapidly. As a result, the pressure inside the oil chamber 154 decreases far below the pressure inside the high-pressure chamber 151 then pushes the main valve spool 142 upward, opening the seat 147 of a large diameter. Consequently, the high pressure of fuel in the high-pressure chamber 151 pours into the annular groove 152 which moderates the torrent of fuel and the generation of cavitation. The groove 152 also acts as a clearance when the seat 147 is grounded. The fuel flowing into the annular groove 152 then passes through the horizontal grooves 153 and reaches the space 150 around the main valve body 141. Thereafter, the fuel flows into the spill passage 104. Thus, the spillage of the pressurized fuel is attained. The delivery of the fuel is controlled by the solenoid valve constructed as described above.

In the above example, the control pump 20 delivers fuel into the common rail 4. By utilizing this fact each cam is made to have plural crests. Hence, the number of the plungers of the pump is the number of the engine cylinders divided by the number of the crests of each cam. Since the number of the plungers can be reduced in this way, the pump can be fabricated inexpensively.

It is also possible not to use cams having some crests. In this case, plungers of the same number as the engine cylinders are provided. Alternatively, the pump camshaft may be rotated at the same speed as the engine, and plungers half of the number of the engine cylinders may be used.

Furthermore, the pressure inside the common rail 4 which can reach as high as 100 MPa or more can be controlled with small valves and small electric currents, because the valves are spill control solenoid pilot valves employing a hydraulic servo mechanism.

Figure 7:
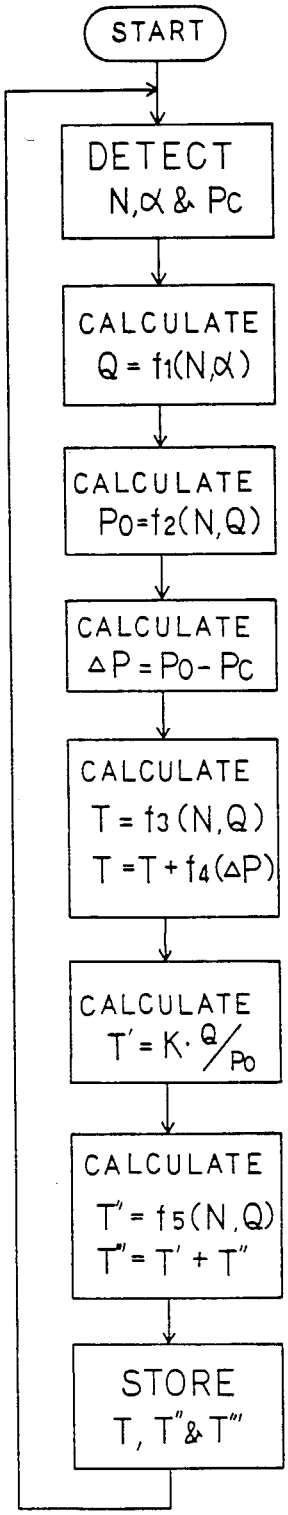
FIGS. 7, 8 and 9 are flow charts illustrating, in flow charts, operations of the electronic control unit shown in FIG. 1.
Figure 8:
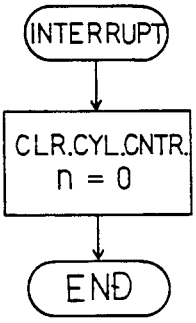
Figure 9:
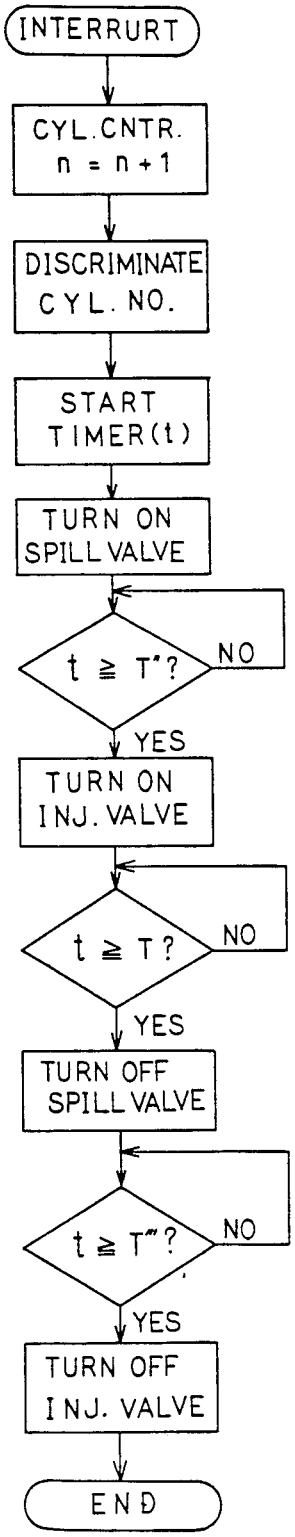

The electronic control unit 11 shown in FIG. 1 may be programmed to perform functions shown in FIGS. 7, 8 and 9.

FIG. 7 shows a main routine which the ECU 11 repeated executes when interrupt routines shown in FIGS. 8 and 9 are not required. As shown in FIG. 7, rotational speed N, load (accelerator position $\alpha$) and actual fuel pressure $P_c$ are detected by the sensors 12, 13 and 14 at first, and a required fuel injection amount Q is calculated from the detected values of N and $\alpha$. Then a desired fuel pressure $P_o$ in the common rail 4 is calculated from the detected value N and the calculated value Q and a difference $\Delta P$ between the values $P_o$ and $P_c$ are calculated. In the next step, time interval T for evergizing the spill valve (see (D), (F) and (H) in FIG. 4) is calculated from the values N and Q and corrected by the difference $\Delta P$. Time interval or injection period T' for energizing the injection valve (see (I) in FIG. 4) is calculated from the values Q and $P_o$. Finally, time period T'' (see (I) in FIG. 4) indicative of time delay of initiating fuel injection from the predetermined cam angle (see (B)in FIG. 4) is calculated and a sum of the time periods T' and T'' are calculated as T''' which indicate stopping fuel injection. These calculated values T, T'' and T''' are stored to be used later in the interrupt routines of FIGS. 8 and 9. It is to be noted that calculations of $Q=f_1(N, \alpha)$, $P_o=f_2(N,Q)$, $T=f_3(N,Q)$, $T''=f_5(N, Q)$ may be performed by use of respective look-up tables known well in the art.

In a first interrupt routine shown in FIG. 8, a cylinder counter indicating cylinder number n to which fuel injection is to be accomplished is cleared to zero (n=0) each time the reference cam angle (0° and 360° CAM) is detected as shown in (A) in FIG. 4.

A second interrupt routine shown in FIG. 9 is performed each time a pulse shown in (B) of FIG. 4 is produced at every predetermined angular rotation (60° CAM). At first, the cylinder counter is incremented (n=n+1) and the cylinder number to which fuel injection is to be made is discriminated in terms of n. Then, a timer counter for measuring lapse of time t from the signal shown in (B) of FIG. 4 is started and the spill control solenoid valve for the discriminated cylinder number n is turned on to close the spill passage. If the measured time t reaches the delay time T'', the injection control solenoid valve corresponding to the discriminated cylinder number n is turned on to start fuel injection. If the measured time t further exceeds the time period T, the spill valve is turned off so that fuel through the spill passage is effectuated. If the measured time t still further reaches the time period T''', the injection valve is turned off to terminate fuel injection.

As described thus far, the invention provides a common-rail high-pressure fuel injection system which has the following features.

(1) Each time fuel is consumed in the injection cycle, it can be replenished by supplying fuel into the common rail. The pressure inside the common rail can be maintained and controlled by the use of a pump that requires only small torque.

(2) The amount of fuel delivery of the pump can be easily and accurately varied by controlling the effective delivery stroke of the pump, using spill control solenoid valves. Hence, neither an expensive governor actuator nor complex control for positioning is required.

What we claim is:

1. A fuel injection system for a diesel engine comprising:

condition detection means for detecting operating conditions of said diesel engine including a rotational position thereof;

low pressure fuel supply means for supplying fuel at a low pressure at an output port thereof;

high pressure fuel pump means, having a pump chamber communicating with said output port of said low pressure fuel supply means, and plunger means reciprocable within said pump chamber for introducing fuel from said output port of said low pressure fuel supply means into said pump chamber during a movement in a predetermined direction of said plunger means and for pressurizing the introduced fuel during a movement of said plunger means in the opposite direction so that pressurized fuel is delivered from said high pressure fuel pump means at an output port thereof;

common rail fuel storage means, connected to said output port of said high pressure fuel pump means, for storing pressurized fuel delivered from said high pressure pump therein at a substantially continuous pressure;

fuel injection means, connected to said common rail fuel storage means and including en electrically-controlled valve, for injecting the pressurized fuel stored in said common rail fuel storage means into said diesel engine, when activated by an injection control signal;

spill passage means for communicating said pump chamber to said low pressure fuel supply means;

electrically-controlled spill valve means, which is normally open and positioned in said spill passage means, for closing said spill passage means in response to a spill control signal applied thereto; and electric control means for producing said injection control signal and said spill control signal, a time period of said injection control signal being determined in accordance with the detected operating conditions of said diesel engine, and said spill control signal being started at a fixed predetermined rotational position of said diesel engine, and ending at a variable time, so that said spill valve means closes said spill passage before said high pressure pump means starts said fuel pressurizing during the movement of said plunger means in said opposite direction and opens the spill passage means in the course of the movement of said plunger means in said opposite direction thereby to maintain the fuel pressure in said fuel storage means.

2. A fuel injection system according to claim 1, wherein said electric control means includes means for determining fuel pressure in said fuel storage means in accordance with the operating conditions of said diesel engine and means for varying periods of said spill control signal and said injection control signal in accordance with the determined fuel pressure.

3. A fuel injection system according to claim 1, wherein said high pressure pump means further has a feed hole communicating with said output port of said low pressure fuel supply means and said plunger means includes a further spill passage which communicates said pump chamber to said feed hole when said plunger means is moved close to the end of the movement in said opposite direction.

4. A fuel injection system according to claim 3, wherein said high pressure pump means has a cam engaging said plunger means and driven by an output shaft of said diesel engine, said cam having two crests so that said plunger means is moved twice in said opposite direction for each rotation of said output shaft.

5. A fuel injection system for electrically controlling an injection of fuel into cylinders of a combustion engine from injection nozzles mounted on the respective cylinders, said fuel injection system comprising:

fuel storage means, connected to the injection nozzles, for storing fuel at a substantially continuous pressure therein;

high-pressure fuel supply pump means, driven by said combustion engine and having pump chambers into which fuel to be pressurized is introduced, for pressurizing the fuel inside the pump chambers and supplying said pressurized fuel to said fuel storage means so that high-pressure fuel is kept therein;

a plurality of low pressure fuel passages;

a plurality of spill passages that connect the pump chambers with said low-pressure fuel passages;

a plurality of spill solenoid valves, at least one for each said spill passage, and which, when opened, permit the fuel in the pump chambers to spill into the low-pressure fuel passages, thereby stopping further pressurization of fuel in said pump chambers; and control means for controlling the spillage of the pressurized fuel from the pump chambers by closing and opening said spill solenoid valves, one of the timings of closing and opening of the spill solenoid valves being fixed at a predetermined rotational position of said diesel engine at which said high-pressure pump is incapable of fuel pressurization, and the other timing being varied in accordance with a fuel quantity injected from said injection nozzles.

6. A fuel injection system according to claim 5, wherein said high-pressure supply pump means is an intermittently reciprocating jerk pump which includes a plurality of cams driven by the combustion engine, a plurality of plungers driven by the cams, and a plurality of plunger barrels in which the plungers are inserted, the barrels having feed holes for placing the pump chambers into communication with the low-pressure fuel passages at a given timing.

7. A fuel injection system according to claim 6, wherein the outer surface of each said plunger is formed with spill grooves that communicate with the feed holes before the end of the delivery stroke of the plunger, and wherein the plungers have communication holes to maintain the spill grooves in communication with the pump chambers.

8. A fuel injection system according to claim 7, further comprising a shaft for driving the cams, which rotates at a speed half of the engine speed, wherein the profile of each cam is so shaped that it has a plurality of crests for driving the plungers, and wherein a number of the plungers is equivalent to a number of the engine cylinders divided by the number of the crests on each cam.

9. A fuel injection system according to claim 7, further comprising a shaft for driving the cams, which rotates at a speed the same as the engine speed, wherein the profile of each cam is so shaped that it has one crest for driving the plungers, and wherein the number of the plungers is equivalent to half of a number of the engine cylinders.

10. A fuel injection system according to claim 8, further comprising a rotary disk mounted on the shaft, for driving the cams, an electromagnetic pickup mounted corresponding to the disk, and a plurality of protrusions formed on the disk, a number of which corresponding to the number of the engine cylinders, and wherein the control means includes means for opening and closing the spill solenoid valves in accordance with an output signal from a pickup that indicates the angular positions of the cams.

11. A fuel injection system of claim 10, wherein the protrusions on the rotary disk are located near the lower dead points in the plunger-driving stroke, and wherein the control means includes means for closing the spill solenoid valves in synchronism with the signals indicating the angular positions of the cams and produced in response to the passage of the protrusions and means for closing the spill solenoid valves during a period corresponding to the angular interval of each cam that is determined from both the engine load and the engine speed, whereby controlling the amounts of delivery from the pump chambers to said fuel storage means.

12. A fuel injection system according to claim 10, further comprising a cylinder discriminator comprising a rotary disk for producing one signal per revolution of the shaft driving the cams and an electromagnetic pickup, in addition to the rotary disk having the same number of protrusions as the number of the engine cylinders, and wherein the control means includes means for successively closing the spill solenoid valves which enter into the delivery stroke, according to the output signal from the cylinder discriminator.

13. The fuel injection system according to claim 10, wherein the control means includes means for controlling the spillage by simultaneously opening or closing the spill solenoid valves for all the cylinders.

14. The fuel injection system according to claim 5, further comprising a pressure sensor, disposed in said fuel storage means to detect a pressure inside said fuel storage means, and wherein the control means further controls said other timing of the spill solenoid valves in such a way that a value indicated by the output signal from the pressure sensor becomes equal to a value which has been previously set according to the engine load and the engine speed.

* * * * *